US008474417B2

(12) United States Patent
Ogawa et al.

(10) Patent No.: US 8,474,417 B2
(45) Date of Patent: Jul. 2, 2013

(54) LUBRICATING SYSTEM FOR AIR-COOLED GENERAL-PURPOSE ENGINE

(75) Inventors: Kazuhisa Ogawa, Wako (JP); Hiroaki Hasebe, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 588 days.

(21) Appl. No.: 12/470,862

(22) Filed: May 22, 2009

(65) Prior Publication Data

US 2009/0301413 A1 Dec. 10, 2009

(30) Foreign Application Priority Data

Jun. 6, 2008 (JP) ..... 2008-149707

(51) Int. Cl.

| | |
|---|---|
| ***F02B 67/00*** | (2006.01) |
| ***F02B 75/22*** | (2006.01) |
| ***F02B 41/00*** | (2006.01) |
| ***F02B 77/04*** | (2006.01) |
| ***F02F 7/00*** | (2006.01) |
| ***F02F 1/10*** | (2006.01) |
| ***F16M 1/00*** | (2006.01) |
| ***F02M 25/00*** | (2006.01) |
| ***F02M 35/02*** | (2006.01) |
| ***F01M 1/06*** | (2006.01) |
| ***F02N 1/00*** | (2006.01) |

(52) U.S. Cl.

USPC ..... 123/41.7; 123/195 A; 123/195 R; 123/198 C; 123/198 E; 123/90.33; 123/179.28; 123/185.2; 123/41.57; 123/41.85; 123/41.56; 123/41.65; 123/41.13; 123/149 D; 123/392; 123/179.1; 123/54.8; 184/6.9; 184/6.5; 184/6.28; 417/364; 181/229; 181/238

(58) Field of Classification Search

USPC ..... 123/195 A, 196 R, 198 C, 41.57, 123/41.85, 90.33, 179.28, 185.2; 184/6.9, 184/6.5, 6.28

See application file for complete search history.

(56) References Cited

U.S. PATENT DOCUMENTS 4,458,641 A * 7/1984 Wickramasuriya ..... 123/195 A
5,090,375 A * 2/1992 Hudson ..... 123/196 W (Continued)

FOREIGN PATENT DOCUMENTS

EP 1 471 229 A1 10/2004
JP 2000-54819 A 2/2000

(Continued)

OTHER PUBLICATIONS

Chinese Office Action dated Feb. 25, 2011, issued in corresponding Chinese Patent Application No. 200910145460.2.

(Continued)

*Primary Examiner* — Lindsay Low
*Assistant Examiner* — Charles Brauch
(74) *Attorney, Agent, or Firm* — Westerman, Hattori, Daniels & Adrian, LLP

(57) ABSTRACT

An air-cooled general-purpose engine includes: a cooling fan fixed to one end portion, protruding outward from one end wall of an engine main body, of a crankshaft; and a shroud which is mounted to the engine main body, and which defines a cooling-air path between the shroud and the one end wall, the cooling-air path guiding a cooling air blown under pressure from the cooling fan. The air-cooled general-purpose engine includes: an oil pump which pumps up an oil from an oil reservoir; and an oil-supply path which is formed in the one end wall, facing the cooling-air path, of the engine main body, and configured to guide the oil discharged from the oil pump to a valve operating chamber in a head portion of the engine main body, and a jet for jetting the oil is provided in an opening of the oil-supply path, the opening being open to the valve operating chamber. Accordingly, it is possible to be excellent in cooling oil and to preferably lubricate a valve operating system in addition to the surrounding of a crankshaft.

3 Claims, 4 Drawing Sheets

U.S. PATENT DOCUMENTS

| | | | | |
|---|---|---|---|---|
| 6,745,741 | B2 | 6/2004 | Liu | |
| 7,523,727 | B2 | 4/2009 | Fujii et al. | |
| 2006/0065218 | A1 * | 3/2006 | Gokan et al. | 123/41.82 R |

FOREIGN PATENT DOCUMENTS

| | | | |
|---|---|---|---|
| JP | 2003-90219 | A | 3/2003 |
| JP | 2005-240795 | A | 9/2005 |
| JP | 2007-177679 | A | 7/2007 |

OTHER PUBLICATIONS

Japanese Office Action dated May 23, 2012, issued in corresponding application No. 2008-149707.

Japanese Office Action dated Dec. 28, 2011, issued in corresponding Japanese Patent Application No. 2008-149707.

* cited by examiner

LUBRICATING SYSTEM FOR AIR-COOLED GENERAL-PURPOSE ENGINE

CROSS-REFERENCE TO RELATED APPLICATIONS

The present invention claims priority under 35 USC §119 based on Japanese patent application No. 2008-149707 filed Jun. 6, 2008. The subject matter of this priority document is incorporated by reference herein.

BACKGROUND OF THE INVENTION

1. Field of the Invention

The present invention relates to an air-cooled general-purpose engine comprising: a cooling fan fixed to one end portion of a crankshaft supported by an engine main body, the one end portion protruding outward from one end wall of the engine main body; and a shroud which is mounted to the engine main body, and which defines a cooling-air path between the shroud and the one end wall, the cooling-air path guiding a cooling air blown under pressure from the cooling fan, and especially relates to an improvement of a lubricating system for said engine.

2. Description of the Related Art

Conventionally, as a lubricating system for a general-purpose engine, a force-feed lubricating system has been known, such as one disclosed in, for example, Japanese Patent Application Laid-open No. 2000-54819, which includes an oil pump for pumping up an oil from an oil reservoir at a bottom portion of an engine main body, and in which the oil discharged by the oil pump is supplied to the surrounding of a crankshaft and also supplied to a valve operating chamber in a head portion of the engine main body.

Meanwhile, an air-cooled general-purpose engine is often operated in a stationary state as in, for example, a power source of an electric generator or the like, and the operation environment is harsh. This makes it difficult to cool an oil for lubricating components of the general-purpose engine, particularly to cool an oil for lubricating a valve operating system that is far away from an oil reservoir in a bottom portion of a crankcase.

SUMMARY OF THE INVENTION

The present invention has been made under such a circumstance. An object of the present invention is to provide a lubricating system for an air-cooled general-purpose engine, the lubricating system being excellent in cooling an oil and capable of preferably lubricating a valve operating system in addition to the surrounding of a crankshaft, by use of the force-feed lubricating system.

In order to achieve the above first object, according to a first feature of the present invention, there is provided an air-cooled general-purpose engine comprising: a cooling fan fixed to one end portion of a crankshaft supported by an engine main body, the one end portion protruding outward from one end wall of the engine main body; and a shroud which is mounted to the engine main body, and which defines a cooling-air path between the shroud and the one end wall, the cooling-air path guiding a cooling air blown under pressure from the cooling fan. The air-cooled general-purpose engine further comprises: an oil pump which pumps up an oil from an oil reservoir in a bottom portion of the engine main body; and an oil-supply path which is formed in the one end wall facing the cooling-air path and configured to guide the oil discharged from the oil pump to a valve operating chamber in a head portion of the engine main body; and a jet for jetting the oil is provided in an opening of the oil-supply path which is open to the valve operating chamber.

According to the first feature of the present invention, the oil discharged from the oil pump is jetted from the jet to the valve operating chamber through the oil-supply path. The oil thus jetted turns into mist, and thus allows preferable lubrication of components of intake and exhaust valves and of a valve operating system in the valve operating chamber.

Furthermore, the oil-supply path is formed in the one end wall, facing the cooling-air path, of the engine main body. Accordingly, the oil-supply path together with the one end wall is effectively cooled by the cooling air blown under pressure from the cooling fan. Thus, an oil whose temperature is increased during the operation of the general-purpose engine is also cooled, while passing through the oil-supply path. Thereby, together with the effect of pressure drop by jetting the oil from the jet, it is possible to form oil mist at an appropriate temperature in the valve operating chamber. Moreover, not only the lubrication of the intake and exhaust valves and the valve operating system but also effective cooling of these components is achieved.

Further, according to a second feature of the present invention, in addition to the first feature, an oil return path through which the oil accumulated in the valve operating chamber returns to the oil reservoir is formed in the other end wall of the engine main body, the other end wall being on an opposite side to the cooling-air path.

According to the second feature of the present invention, the oil-supply path and the oil return path are formed in different regions of the engine main body; the one end wall and the other end wall, respectively. This makes it possible to prevent the formation of the oil-supply path and the oil return path from reducing the strengths of the one end wall and the other end wall as much as possible.

Here, the one end wall and the other end wall correspond respectively to a front end wall 1*f* and a rear end wall 1*r* of an embodiment of the present invention which will be described below.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be explained below based on FIG. 1 to FIG. 4.

Figure 1:
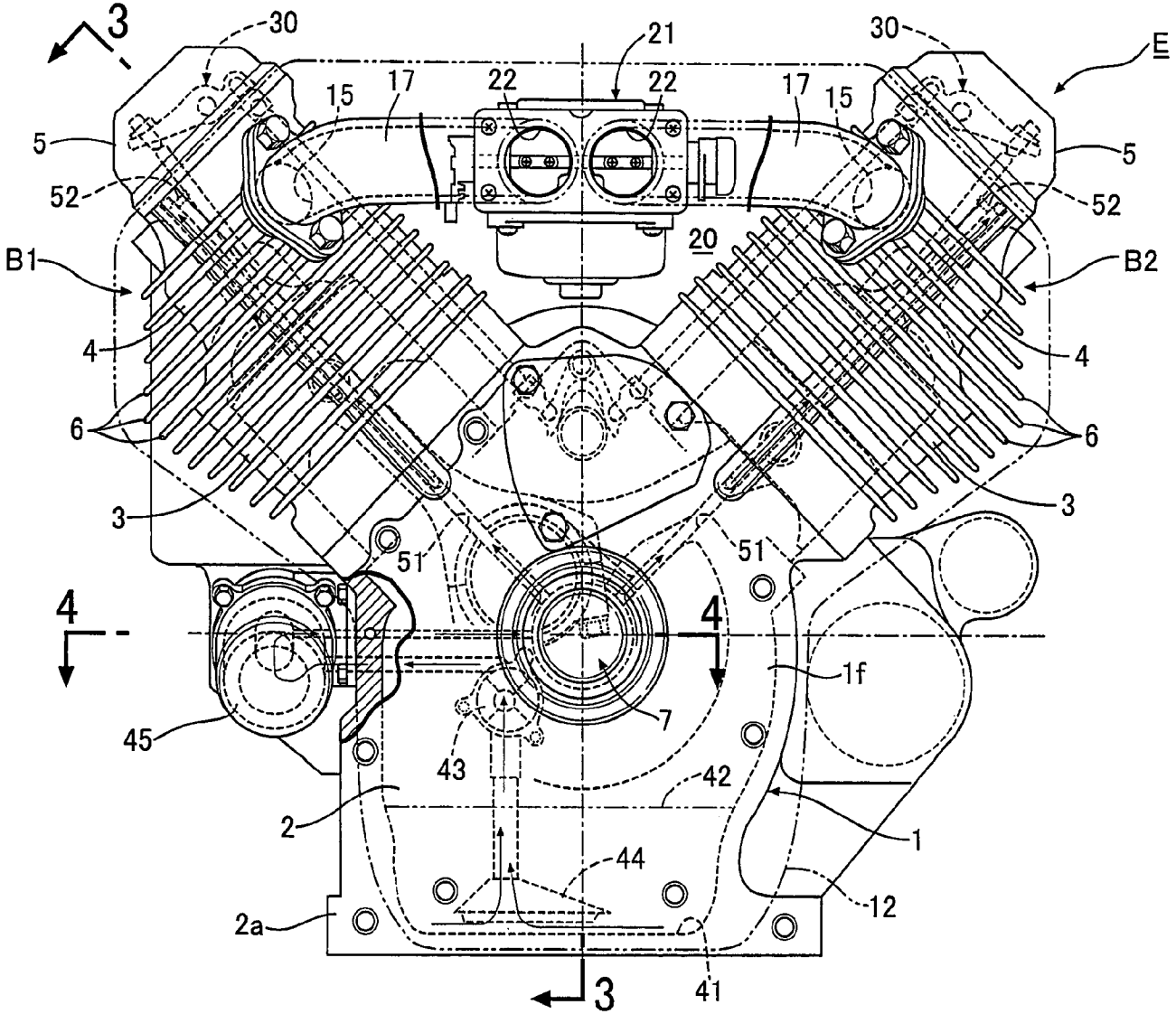
FIG. 1 is a front view showing an air-cooled general-purpose V-type general-purpose engine including a lubricating system of the present invention with a cooling fan being removed (a cross-sectional view taken along a line 1-1 in FIG. 3)
Figure 2:
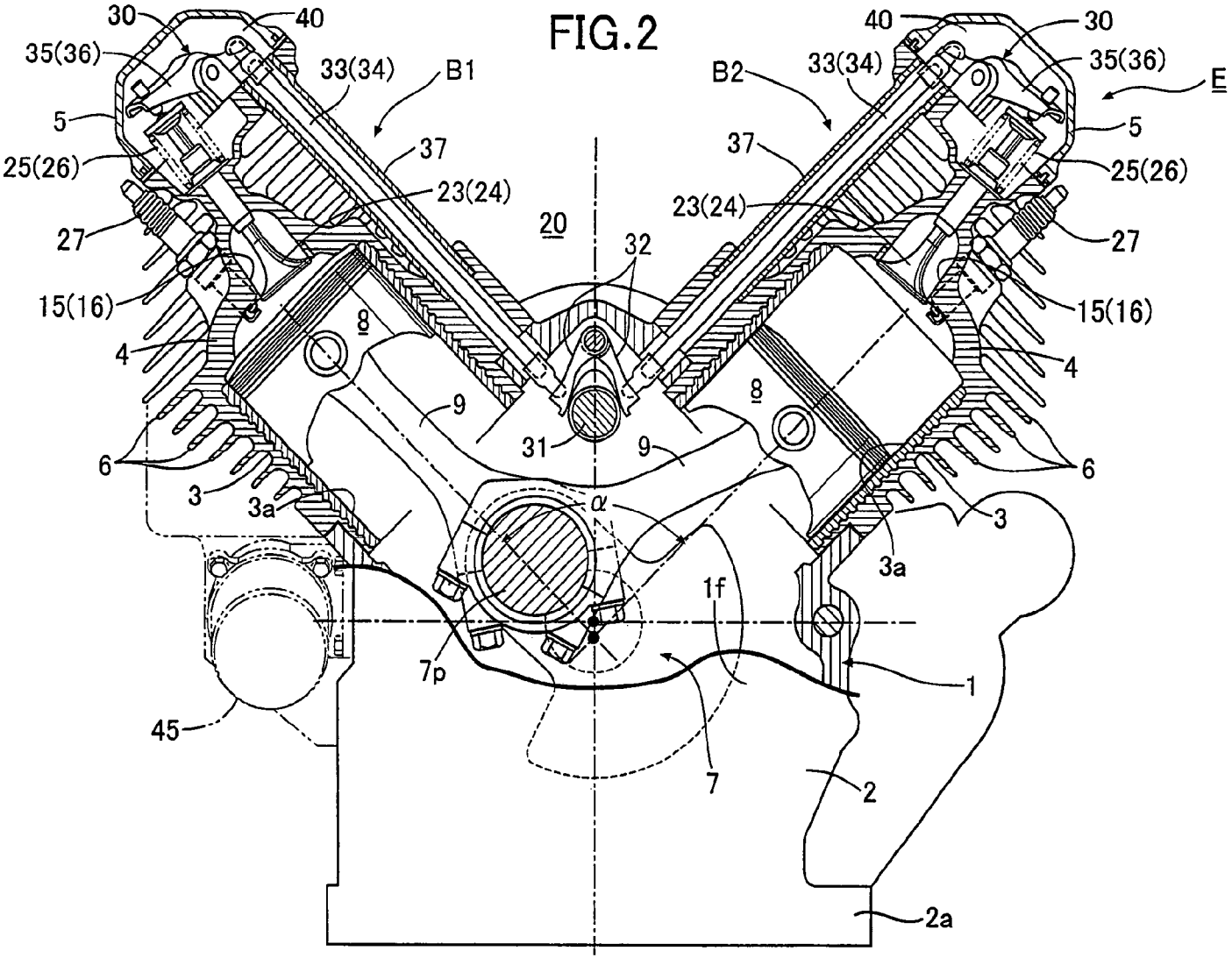
FIG. 2 is a longitudinal cross-sectional front view of an essential part of the same general-purpose engine (a cross-sectional view taken along a line 2-2 in FIG. 3)

Firstly, in FIGS. 1 and 2, an engine body 1 of an air-cooled general-purpose V-type general-purpose engine includes: a crankcase 2; a first bank B1 and a second bank B2 which are arranged respectively on the left and right sides in a V-shape, and which are connected to an upper portion of the crankcase 2. An installation flange 2*a* is formed in a bottom portion of the crankcase 2. The first and second banks B1 and B2 are arranged in such a manner that the included angle α between the banks B1 and B2 is set at 90°.

Each of the first and second banks B1 and B2 includes: a cylinder block 3 which has a cylinder bore 3*a*, and which is bolt-coupled to the crankcase 2; and a cylinder head 4 which has a combustion chamber 4*a* leading to the cylinder bore 3*a*, and which is integrally connected to the cylinder block 3. A head cover 5 is bolt-coupled to an end surface of the cylinder head 4. Each of the banks B1 and B2 is integrally molded, and has a large number of cooling fins 6 integrally formed to protrude from an outer surface of the bank.

Figure 3:
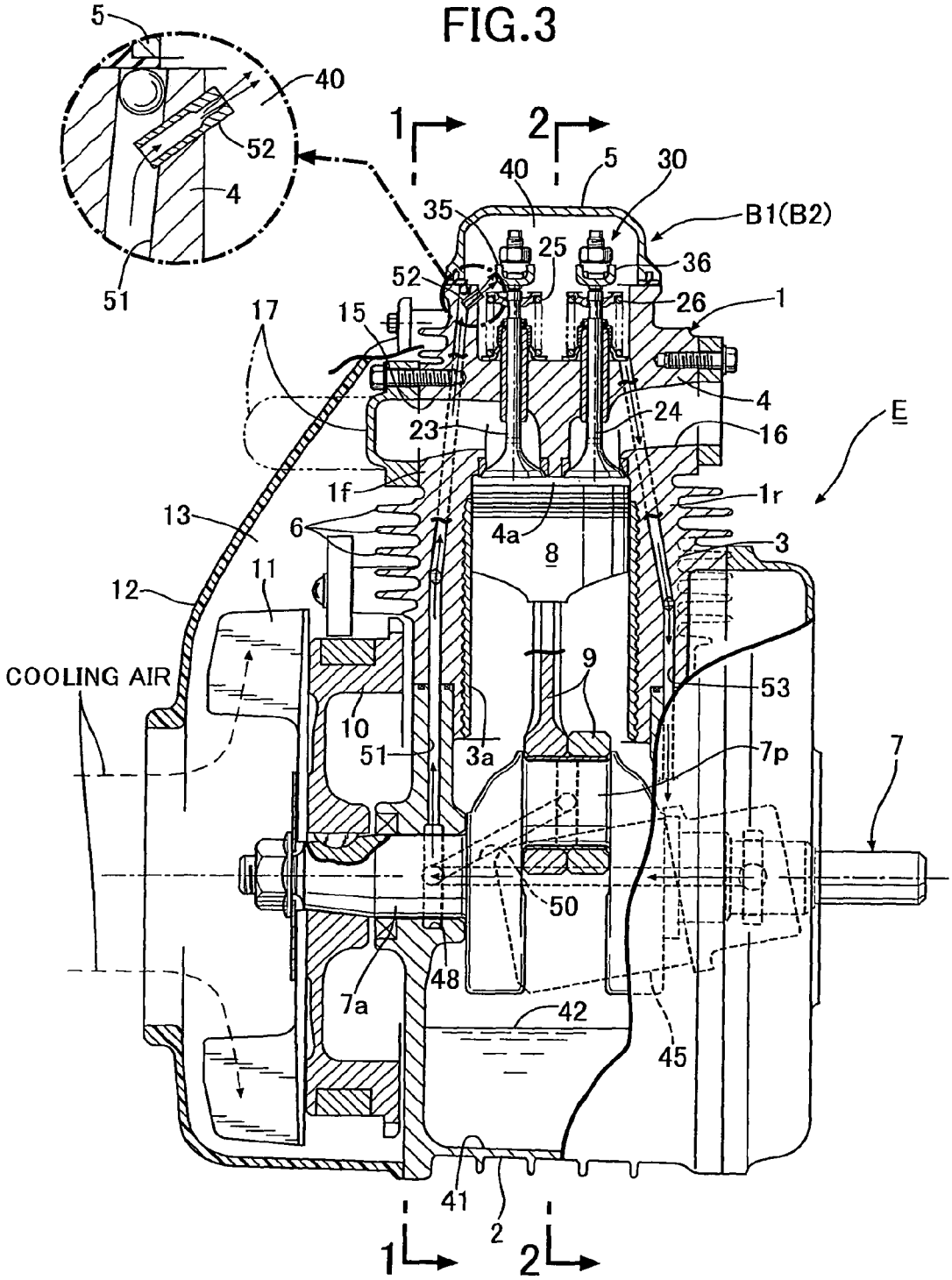
FIG. 3 is a cross-sectional view taken along a line 3-3 in FIG. 1.
Figure 4:
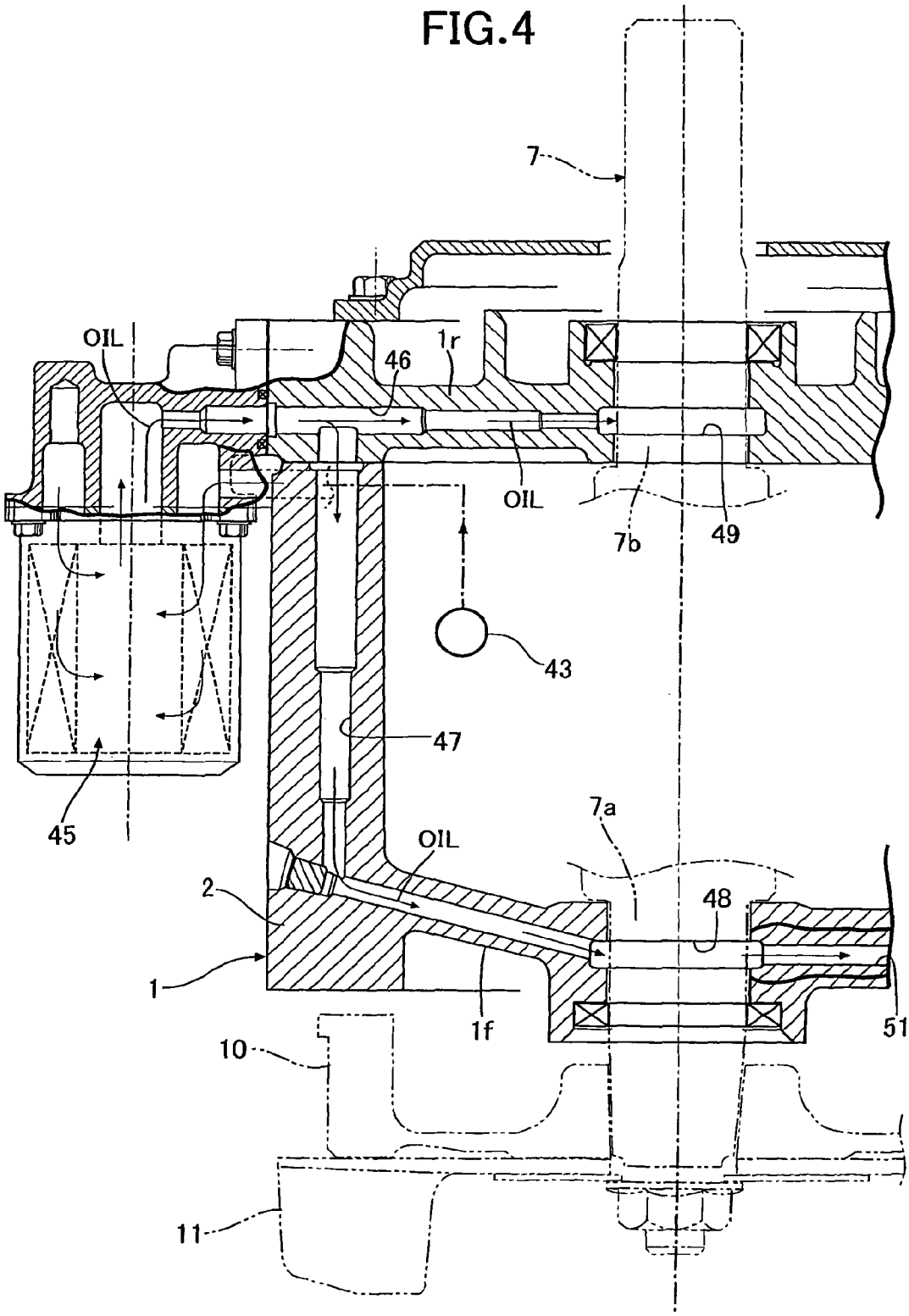
FIG. 4 is a cross-sectional view taken along a line 4-4 in FIG. 1.

The crankcase 2 supports a pair of front and rear journal portions 7*a* and 7*b* of a crankshaft 7 respectively at front and rear end walls of the crankcase 2 (see FIGS. 3 and 4). Pistons 8, which are fitted respectively into cylinder bores 3*a* of the first and second banks B1 and B2, are each continuously connected to a crankpin 7*p* of the crankshaft 7 with a connecting rod 9 interposed therebetween.

A cooling fan 11 is fixed, together with a flywheel 10, to one end portion, protruding out from a front surface of the crankcase 2, of the crankshaft 7. A shroud 12 is mounted to a front surface of the engine body 1. While the cooling fan 11 draws an outside air, the shroud 12 guides, as a cooling air, the outside air to the surroundings of the banks B1 and B2 as well as the surrounding of a carburetor 21, which will be described later. In other words, the shroud 12 defines a cooling-air passage 13 between the shroud 12 and the front surface of the engine body 1. The cooling air is thus supplied through the cooling-air passage 13 to the surroundings of the banks B1 and B2 as well as of the carburetor 21.

Hereinafter, one end wall of the engine body 1 on the cooling-air passage 13 side is referred to as a front end wall 1*f*, and the other end wall opposite to the front end wall 1*f* is referred to as a rear end wall 1*r*. The other end portion of the crankshaft 7 protrudes outward from the rear end wall 1*r* as an output part.

Intake and exhaust ports 15 and 16 opening to the combustion chamber 4*a* are formed in each of the cylinder heads 4, 4 of the respective first and second banks B1 and B2. An upstream end of each intake port 15 opens on the front surface side of the corresponding cylinder head 4. Intake pipes 17, 17 are fixed respectively to the cylinder heads 4, 4, and twin carburetor 21 is arranged in a center portion of a valley portion 20 between the first and second banks B1 and B2. The intake ports 15, 15 of the first and second banks B1 and B2 communicate respectively with intake passages 22, 22 of the twin carburetor 21 through the corresponding intake pipes 17, 17.

As shown in FIGS. 2 and 3, intake and exhaust valves 23 and 24, which open and close the intake port 15 and the exhaust port 16, respectively, are attached to each of the cylinder heads 4 of the first and second banks B1 and B2. Valve springs 25 and 26 are mounted respectively on the intake and exhaust valves 23 and 24 so as to urge the corresponding valves 23 and 24 in a valve-closing direction. In addition, an ignition plug 27 having an electrode opposed to the combustion chamber 4*a* is screwed into each of the cylinder heads 4.

In FIGS. 2 and 3, a valve operating system 30 for opening and closing the intake and exhaust valves 23 and 24 in each of the first and second banks B1 and B2 is laid from the crankcase 2 to the corresponding cylinder head 4 of the respective banks B1 and B2. The valve operating systems 30 include a camshaft 31 rotatably supported by the front and rear end walls of the crankcase 2 in parallel with, and directly above, the crankshaft 7. The camshaft 31 is driven at a speed reduction ratio of 1/2 by the crankshaft 7 via an unillustrated timing transmission system. The camshaft 31 includes intake and exhaust cams integrally formed therewith. These intake and exhaust cams are continuously connected respectively to intake and exhaust push rods 33 and 34 in each of the banks B1 and B2 via cam followers 32 pivotally supported by the crankcase 2, and further respectively to the intake and exhaust valves 23 and 24 via intake and exhaust rocker arms 35 and 36 pivotally supported by the corresponding cylinder head 4. The intake and exhaust push rods 33 and 34 are housed in a tubular rod cover 37 arranged along a side surface, on the valley portion 20 side, of each of the banks B1 and B2.

The valve operating systems 30 are constituted as described above. Each valve operating system 30 opens and closes the intake and exhaust valves 23 and 24 in cooperation with the valve springs 25 and 26 in accordance with intake and exhaust strokes of the piston 8 in the respective banks B1 and B2.

In each of the banks B1 and B2, the intake and exhaust rocker arms 35 and 36 are housed in a valve operating chamber 40 defined between the cylinder head 4 and head cover 5. The valve operating chamber 40 communicates with the inside of the crankcase 2 through a hollow portion of the corresponding rod cover 37.

Next, a lubricating system for the general-purpose engine E will be described with reference to FIGS. 1, 3 and 4.

A bottom portion of the crankcase 2 is formed into an oil reservoir 41 for reserving lubricating oil 42. The oil 42 is pumped up through an oil strainer 44 by an oil pump 43 driven by the crankshaft 7, and then is sent with pressure to an oil filter 45 mounted on one side of the crankcase 2. As shown in FIG. 4, the flow of the oil filtered by the oil filter 45 and sent out therefrom branches into two parts flowing into first and second branch oil paths 46, 47 that are formed in the engine main body 1. The oil reaches first and second annular oil paths 48, 49 to lubricate the journal portions 7*a*, 7*b*. The first and second annular oil paths 48, 49 are provided in the front end wall 1*f* and the rear end wall 1*r* of the engine main body 1, and surround the journal portions 7*a*, 7*b* on the front and rear sides of the crankshaft 7, respectively.

Then, the oil that has lubricated one of the journal portions (in the illustrated example, the journal portion 7*a* on the front side) is supplied to an outer peripheral surface of the crankpin 7*p* through an oil hole 50 provided in the crankshaft 7. After lubricating the surrounding of a big end portion of the connecting rod 9, the oil spreads therearound to lubricate the piston 8 and the like.

As clearly shown in FIGS. 1 and 3, a pair of left and right supply oil passages 51, 51 (only one of which is illustrated in FIG. 3) are formed in the front end wall 1*f*, facing the cooling-air passage 13, of the engine body 1. The left and right supply oil passages 51, 51 extend from the first annular oil passage 48 respectively to the valve operating chambers 40 of the first and second banks B1 and B2. Jets 52 for injecting oil to the valve operating systems 30 inside the valve operating chambers 40 are provided to opening portions, to the corresponding valve operating chambers 40, of the respective supply oil passages 51. The inner diameter of the jets 52 is set to be sufficiently smaller than the inner diameter of the supply oil passages 51.

On the other hand, a pair of left and right return oil passages 53, 53 (only one of which is illustrated in FIG. 3) are formed in the rear end wall 1*r* of the engine body 1. The oil is returned from the lower portion of the valve operating chamber 40 in each of the first and second banks B1 and B2 to the oil reservoir 41 in the crankcase 2 through the corresponding return oil passage 53.

Accordingly, as described above, the oil sent with pressure from the oil pump 43 to the first annular groove 48 is not only supplied to the oil hole 50 provided in the crankshaft 7 but also supplied to the supply oil passage 51 in each of the first and second banks B1 and B2, and is injected into each valve operating chamber 40 from the corresponding jet 52. The oil thus injected into the valve operating chamber 40 is misted, so that the intake and exhaust valves 23 and 24 as well as each part of the valve operating system 30 inside the valve operating chamber 40 can be favorably lubricated.

Furthermore, the supply oil passage 51 in each of the banks B1 and B2 is formed in the front end wall 1*f*, facing the cooling-air passage 13, of the engine body 1. For this reason, the supply oil passage 51 is effectively cooled down together with the front end wall 1*f* by the cooling air sent with pressure from the cooling fan 11. Accordingly, during an operation of the general-purpose engine E, the oil with high temperature is cooled down while passing through the supply oil passage 51, and an oil mist at an appropriate temperature can be generated in each valve operating chamber 40 in cooperation with a reduction in pressure due to the oil injection from the jet 52. As a result, it is possible not only to lubricate, but also to effectively cool down, the intake and exhaust valves 23 and 24 as well as the valve operating system 30.

After being used for lubricating each valve operating system 30, the oil is liquefied and reserved in the bottom portion of the valve operating chamber 40. The oil then flows down through the return oil passage 53 so as to return the oil reservoir 41 in the crankcase 2. With the above-described operation, the durability of the general-purpose engine E is improved, so that a harsh long-term stationary operation of the engine E is enabled.

In addition, each supply oil passage 51 and each return oil passage 53 are formed respectively in the front end wall 1*f* and the rear end wall 1*r* of the engine main body 1 in a distributed manner. For this reason, the front end wall 1*f* and the rear end wall 1*r* can be prevented as much as possible from being reduced in strength due to the formation of the supply oil passages 51 and the return oil passages 53.

An embodiment of the present invention is explained above, but the present invention may be modified in a variety of ways as long as the modifications do not depart from its gist. For example, in lubricating the inside of the crankcase 2, it is possible to utilize a splash oiling system with an oil dipper or an oil slinger. Moreover, the present invention is also applicable to a single-cylinder or multiple-cylinder in-line general-purpose engine.

The invention claimed is:

1. In an air-cooled general-purpose engine comprising:

a cooling fan fixed to one end portion of a crankshaft supported by an engine main body, the one end portion protruding outward from one end wall of the engine main body; and a shroud which is mounted to the engine main body, and which defines a cooling-air path between the shroud and the one end wall, the cooling-air path guiding a cooling air blown under pressure from the cooling fan, a lubricating system for the air-cooled general-purpose engine, comprising:

an oil pump which pumps up an oil from an oil reservoir in a bottom portion of the engine main body; and an oil-supply path which is formed in the one end wall facing the cooling-air path and configured to guide the oil discharged from the oil pump to a valve operating chamber in a head portion of the engine main body, wherein a jet for jetting the oil is provided in an opening of the oil-supply path which is open to the valve operating chamber, the cooling fan supplies cooling air inside the cooling-air path, and an inner diameter of the jet is smaller than an inner diameter of the oil-supply path.

2. The lubricating system for the air-cooled general-purpose engine according to claim 1, wherein an oil return path through which the oil accumulated in the valve operating chamber returns to the oil reservoir is formed in the other end wall of the engine main body, the other end wall being on an opposite side to the cooling-air path.

3. The lubricating system for the air-cooled general-purpose engine according to claim 1, wherein the oil pump is driven by the crankshaft.

* * * * *